US008826522B2

(12) United States Patent
Roblot

(10) Patent No.: US 8,826,522 B2
(45) Date of Patent: Sep. 9, 2014

(54) METHOD AND SET OF TOOLS FOR INSERTING FERRITE MEMBERS ONTO ELECTRICAL FILTER CONNECTORS

(75) Inventor: Robert Roblot, Sartrouville (FR)

(73) Assignee: Souriau SAS, Versailles (FR)

( * ) Notice: Subject to any disclaimer, the term of this patent is extended or adjusted under 35 U.S.C. 154(b) by 69 days.

(21) Appl. No.: 13/481,010

(22) Filed: May 25, 2012

(65) Prior Publication Data

US 2012/0311860 A1 Dec. 13, 2012

(30) Foreign Application Priority Data

Jun. 7, 2011 (FR) ..... 11 01719

(51) Int. Cl.

| | |
|---|---|
| ***H01R 43/20*** | (2006.01) |
| ***H01R 43/22*** | (2006.01) |
| ***H01R 43/045*** | (2006.01) |
| *H01R 13/7193* | (2011.01) |
| *H01R 13/7197* | (2011.01) |

(52) U.S. Cl.

CPC ..... *H01R 43/22* (2013.01); *H01R 13/7193* (2013.01); *H01R 13/7197* (2013.01); *H01R 43/045* (2013.01)

USPC ..... 29/747; 29/739; 29/745; 29/729; 29/874; 29/876; 29/825; 29/592.1

(58) Field of Classification Search

CPC ..... H01R 13/7193; H01R 13/7197; H01R 43/22; H01R 43/045

USPC ..... 29/747, 745, 729, 700, 876, 874, 825, 29/592.1, 758, 750, 739

See application file for complete search history.

(56) References Cited

U.S. PATENT DOCUMENTS

| | | | | |
|---|---|---|---|---|
| 3,883,001 | A | 5/1975 | Burkin et al. | |
| 3,933,247 | A * | 1/1976 | Smith | 209/565 |
| 4,262,268 | A | 4/1981 | Shimada et al. | |
| 8,167,625 | B2 * | 5/2012 | Shedletsky | 439/55 |
| 2003/0209820 | A1 | 11/2003 | Paris et al. | |

FOREIGN PATENT DOCUMENTS

| | | | |
|---|---|---|---|
| CN | 201626061 | U | 11/2010 |
| EP | 1174964 | A1 | 1/2002 |

OTHER PUBLICATIONS

Great Britain Search Report, dated Aug. 2, 2012, (2 pages).
French Search Report, dated Nov. 7, 2011, (1 page).

* cited by examiner

*Primary Examiner* — Peter DungBa Vo
*Assistant Examiner* — Azm Parvez
(74) *Attorney, Agent, or Firm* — The Maxham Firm

(57) ABSTRACT

A method for the insertion of ferrite members onto pins acting as the contacts of an electrical filter connector. The ferrite members are oriented to a desired orientation by a known method. The ferrite members are preferably oriented in the vertical position for storage and are conveyed to a dynamic storage lock chamber equipped with a ferrite member stopping mechanism. A ferrite member distribution system incorporating a horizontally moving distribution plate individually releases the ferrite members from the lock chamber into the distribution system and inserts ferrite members onto the contacts according to a rate controlled by the operator.

9 Claims, 2 Drawing Sheets

METHOD AND SET OF TOOLS FOR INSERTING FERRITE MEMBERS ONTO ELECTRICAL FILTER CONNECTORS

FIELD OF INVENTION

This concept relates to a method for the insertion of tubular ferrite members onto the contacts of an electrical filter connector and to a set of insertion tools for inserting ferrite members onto the contacts of an electrical filter connector.

BACKGROUND OF THE INVENTION

The relevant technology area is the manufacture and maintenance of electrical connectors using contacts fitted with members which filter or protect against overloads generated by electromagnetic surges and electrostatic discharges and against radio frequency and electromagnetic interferences. As is well-known in the aforementioned prior art, these filtering elements usually consist of ceramic tubular sockets known as ferrite members. Such filtering elements are quite small and, for that reason, are particularly difficult to fit with the contacts, given their small size.

During the manufacturing of electrical filter connectors with a high density of contacts, the insertion of ferrite members onto pin contacts is a particularly delicate operation as several manual steps have typically been required and the operators must pay constant careful attention. Operators must first count the number of pins on each connector and prepare the corresponding number of ferrite members.

The ferrite member sockets are placed into a box which is then shaken by the operator to get as many of them as possible standing on end in a vertical position. The operator then uses a pair of tweezers to pick up a socket and insert it onto the relevant contact in a coaxial position.

The shaking, vertical positioning, picking up, moving, and insertion operations must be repeated as many times as required to complete the connector which involves additional tiredness for operators performing small repetitive and delicate movements and requires great concentration.

A method and a set of tools which facilitate the insertion of tubular sockets and which resolve the aforementioned problems, allowing the ferrite members to be distributed one-by-one and placed directly on the relevant contact, so reducing the difficulties associated with assembly operations, have not previously been known.

SUMMARY OF EMBODIMENTS OF THE INVENTION

The present concept is addressed to a method for inserting ferrite members onto the contact pins of electrical filter connectors in which the ferrite members are stored and conveyed to a lock chamber located at the inlet to a ferrite member distribution system which inserts members according to a rate controlled by the operator.

In one mode of operation, the ferrite members are initially oriented in a vertical position by any appropriate means. In this operating mode the ferrite members can be oriented and conveyed using a known vibrating feed bowl, for example.

According to another mode of operation, the lock chamber located at the inlet to the distribution system dynamically stores the ferrite members in the vertical position. According to this mode the walls of the lock chamber do not cause wear to the surface coating of the ferrite members.

In yet another mode of operation, the ferrite member distribution system transfers the ferrite members between the lock chamber and the contact pin through channels, and insertion is controlled by the operator using a lever which operates a distribution plate.

In one embodiment the ferrite member distribution system is fixed and the relevant connector is positioned on a cross-travel table.

In an alternative embodiment the relevant connector is fixed and the ferrite member distribution system is movable.

This concept also discloses the use of a set of tools to insert ferrite members onto the contact pins of electrical filter connectors. A method known as a vibrating feed bowl can be used to orient the ferrite members and store them in the vertical position. They are then conveyed to a dynamic storage lock chamber equipped with a ferrite member stopping mechanism and a ferrite member distribution system incorporating a horizontally moving distribution plate which releases and inserts ferrite members according to a rate controlled by the operator.

According to one feature, the storage lock chamber includes an open central channel, the walls of which are coated with insulation material.

According to another feature, the bottom surface of the storage lock chamber includes a groove for the horizontal motion of the distribution plate.

According to yet another feature, the distribution system includes a central guide channel for ferrite members to which access is permitted by the motion of the distribution plate.

In still another feature, the horizontal motion plate is controlled by a lever located on the side wall of the distribution system.

BRIEF DESCRIPTION OF THE DRAWING

The objects, advantages, and features of the embodiments of the invention will be more clearly perceived from the following detailed description, when read in conjunction with the accompanying drawing, in which.

DETAILED DESCRIPTION OF EMBODIMENTS OF THE INVENTION

Figure 1:
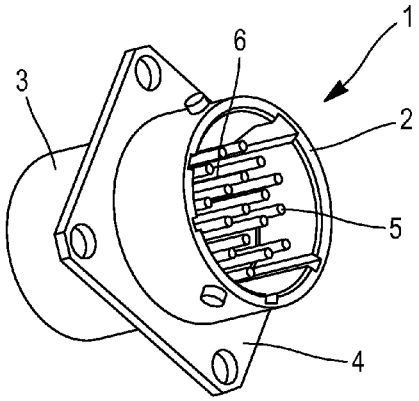
FIG. 1 (Prior Art)
FIG. 1 is a perspective view of a prior art electrical connector socket.

FIG. 1 shows the receptacle 1 of a known electrical filter connector including circular flange 2 and circular flange 3 located on either side of flange 4. Flanges 2 and 3 define a central space fitted with insulation material (not shown) which holds connector pin contacts 5 in place. Each contact is fitted with a filter element, not visible in FIG. 1, made up of certain tubular sockets, known as ferrite members 6, surrounding contacts 5 in a coaxial position.

Figure 3:
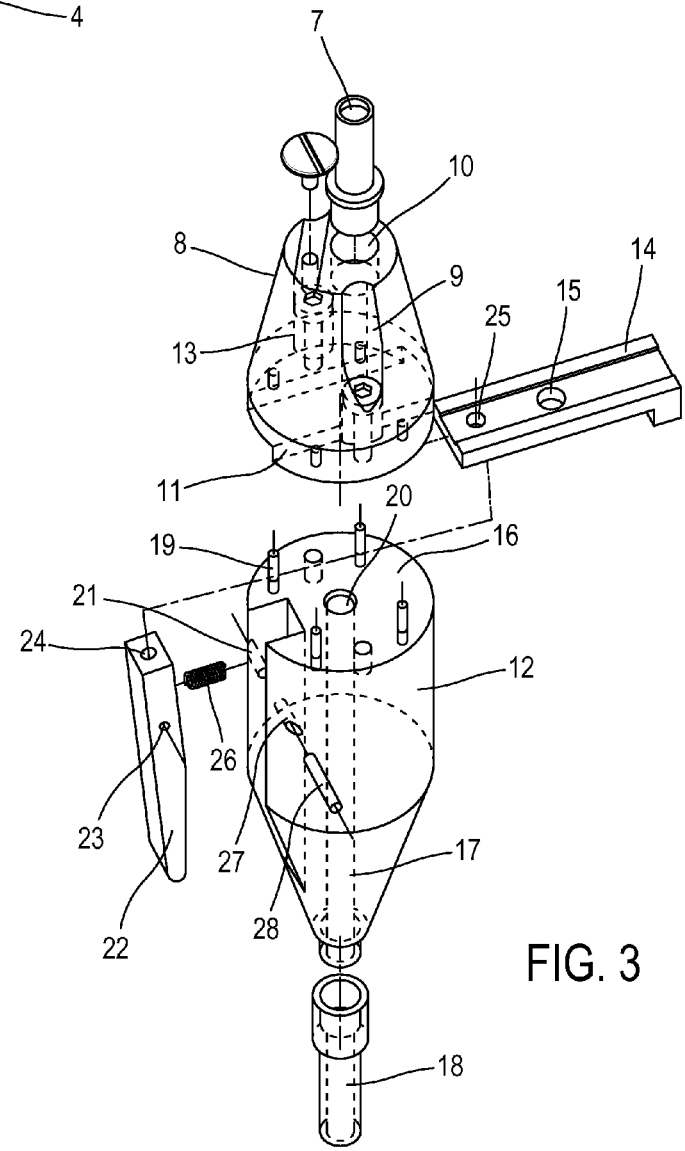
FIG. 3 is an exploded perspective view of the set of tools in accordance with an embodiment of this invention.

According to this concept, the placement of these ferrite members on the connector contacts is made easier by the use of the tool shown in FIG. 3. This figure shows the inlet end of channel 7 from which ferrite members 6 (FIG. 2), arriving in a pre-oriented condition from a storage reservoir, are introduced into lock chamber 8.

The upstream ferrite members may be oriented by means of a vibrating feed bowl in a conventional manner and stored, and then they are conveyed through channel 7 to the inlet of lock chamber 8.

During this stage tubular sockets 6 are positioned on one of their ends in such a way that these ferrite members are automatically presented in a vertical position before being conveyed and introduced into lock chamber 8.

The lock chamber is equipped with through channel 9 which receives at its top end 10 the end of ferrite member conveyor tube 7. Channel 9 is used to dynamically store ferrite members 6 in a vertical position and its walls are coated with an insulation material which prevents wear to the external surfaces of the ferrite members.

The bottom end of lock chamber 8 includes an abutting surface 11 for coupling to top surface 16 of ferrite member distribution system 12.

Surface 11 has recess 13 which holds movable distribution plate 14 in place. This movable plate selectively retains ferrite members 6 present in channel 9 (see FIG. 2). Plate 14 has opening 15, the function of which is explained below.

Distribution system 12 consists of a main cylindrical body which has cone-shaped element 17 at its lower end. This gives system 12 the general shape of a pencil, thereby facilitating handling by the operator in charge of inserting ferrite members 6. The cone-shaped body has nozzle 18 at its lower end for positioning the ferrite members coaxially on pins 5 of the relevant connector.

Upper surface 16 of the distribution system includes four bolts 19, as shown in FIG. 3, for marrying lock chamber assembly 8 to distribution system 12. The latter includes central channel 20 which guides the ferrite members, and lateral recess 21 which houses control lever 22. This lever moves horizontal plate 14 as is shown in FIG. 2.

The lever has a small hole 23 for receiving spindle 28 positioned in hole 27 of the body of system 12 and traversing recess 21. Hole 24 receives spindle 29 (shown in FIGS. 2*a*-2*c*) which couples lever 22 and distribution plate 14 by means of hole 25 in the distribution plate. Lever 22 rotates around spindle 28 when the lever is installed in recess 21, allowing the horizontal motion of plate 14 to be controlled by the lever. Spring 26 is positioned below spindle 28 to thereby bias the upper end of lever 22 to the right as shown in the drawings.

Figure 2A:
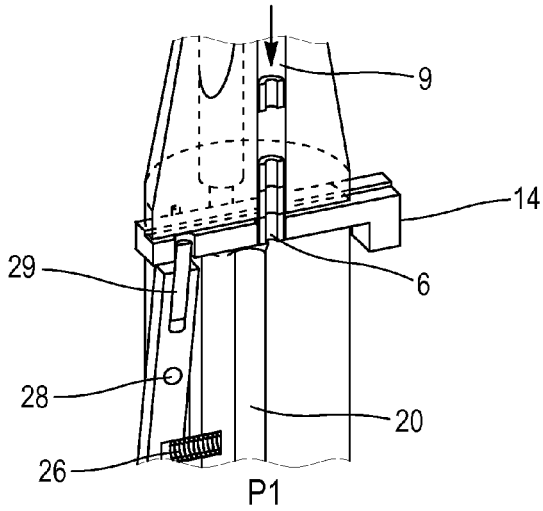
FIGS. 2*a*-2*c* shows motion stages of the ferrite members in the distribution system in accordance with an embodiment of this invention.
Figure 2B:
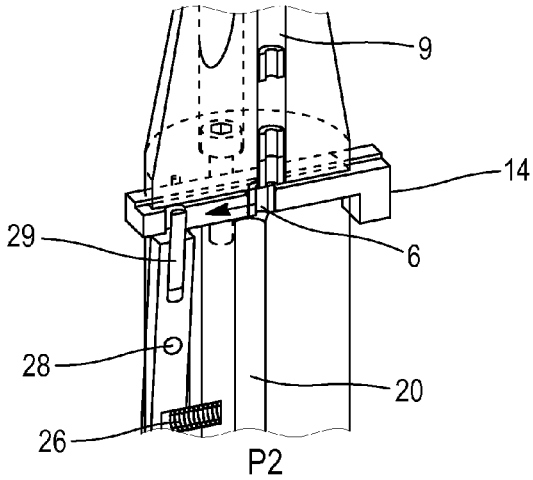
Figure 2C:
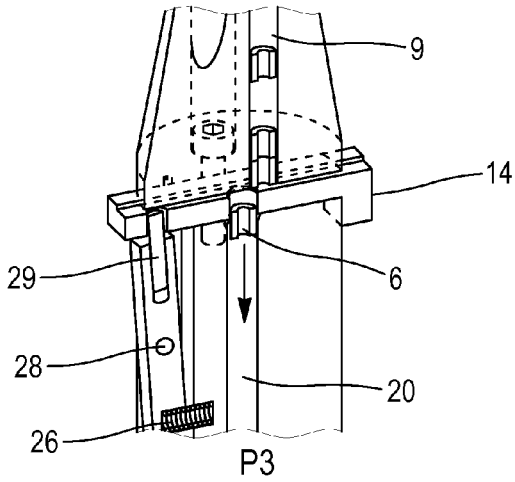

FIGS. 2*a*-2*c* shows the three positions, P1, P2 and P3, of distribution plate 14 during various horizontal motions.

During assembly of distribution system 12 and lock chamber 8, plate 14 is positioned in recess 13 with a clearance. In the home, or biased condition of plate 14, the position of opening 15 corresponds to the position of the exit opening of channel 9 of lock chamber 8. In this position P1, plate 14 covers the inlet opening of the central ferrite member guide channel 20 as the axes of the openings of channels 9 and 20 are offset. As can be seen in FIG. 2*a*, the first of ferrite members 6 stored in the lock chamber is positioned in opening 15. Top surface 16 of distribution system 12 is the initial stop for the first ferrite member and consequently the column of ferrite members 6 dynamically stored in channel 9 of the lock chamber.

FIG. 2*b* shows plate 14 in position P2 after an horizontal movement effected by the operator using lever 22. The pivoting motion of lever 22 around spindle 28 moves plate 14 toward the left in the figure. This motion starts moving the first ferrite member 6 and the top surface of plate 14 acts as a second stopping mechanism for the remaining column of ferrite members stored in lock chamber channel 9.

FIG. 2*c* shows plate 14 in position P3 once lever 22 has run its course, leading to opening 15 of plate 14 being positioned over central channel 20, allowing ferrite member 6 transported by plate 14 to be released, which is then guided and inserted onto receptacle contacts 5 by nozzle 18.

The set of tools described above therefore allows for the ferrite members to be inserted onto contacts 5 of the filter connector at a rate controlled by the operator.

It should be noted that this method allows members to be inserted onto the contacts of a connector positioned on a cross-motion table which moves the connector in the X-Y axes while the distribution system is fixed. An alternative is to have the connector in a fixed position and the distribution system movable in X-Y axes.

This structure and method are not limited to the characteristics of the process and devices described. It also covers any device allowing tubular sockets to be inserted onto pins or sockets of filter connectors. The concept therefore relates to all connection devices with circular, polygonal, or male/female connectors used for the connection of cables, cards, harness, umbilical, and racks.

What is claimed is:

1. A set of tools for insertion of ferrite members onto contact pins of an electrical filter connector, the ferrite members being in a pre-oriented condition upon entering the set of tools and moving in a predetermined general direction in the set of tools, the set of tools comprising;

a dynamic storage lock chamber arranged to receive the ferrite members at one end in a consistent orientation;

a moveable distribution plate haying a ferrite member stopping position and a ferrite member releasing position, said movable plate being arranged at the opposite end of said storage lock chamber and being oriented laterally with respect to the predetermined direction or movement of the ferrite members;

a ferrite member distribution system coupled to said storage lock chamber with said movable plate being located at the interface between said storage lock chamber and said distribution system and configured to slide laterally to individually feed ferrite members from said storage lock chamber to said distribution system; and an exit nozzle at the end of said distribution system opposite to said storage lock chamber through which pass the ferrite members to be applied to the contact pins, said movable plate and a rate at which the ferrite members are fed to said exit nozzle being controlled by an operator.

2. The set of tools according to claim 1, wherein said lock chamber includes a channel coated with an insulation material.

3. The set of tools according to claim 1, wherein said lock chamber is firmed with a recess in a bottom StErfaCe allowing, said distribution plate to move and be displaced.

4. The set of tools according to claim 1, wherein said distribution system has a central ferrite member guide channel, access to which is controlled by displacement of said distribution plate.

5. The set of tools according to claim 1, wherein movable distribution plate is actuated by a lever located on a side wall of said distribution system.

6. The set of tools according to claim 5, wherein said lever is biased in a direction to urge said distribution plate to the stopping position.

7. A set of tools for insertion of ferrite members onto contact pins of an electrical filter connector, the ferrite members being in a pre-oriented condition upon entering the set of tools and moving in a predetermined general direction in the set of tools, the set of tools comprising:

a dynamic storage lock chamber arranged to receive the ferrite members at one end in a consistent orientation;

a moveable distribution plate having a ferrite member stopping position and a ferrite member releasing position, said movable plate being arranged at the opposite end of said lock chamber, wherein said lock chamber is formed with a recess in a bottom surface allowing said distribution plate to move and be displaced;

a ferrite member distribution system coupled to said storage lock chamber with said movable plate being located at the interface between said storage lock chamber and said distribution system; and an exit nozzle at the end of said distribution system opposite to said storage lock chamber through which pass the ferrite members to be applied to the contact pins, said movable plate and a rate at which the ferrite members are fed to said exit nozzle being controlled by an operator.

8. A set of tools for insertion of ferrite members onto contact pins of an electrical filter connector, the ferrite members being in it pre-oriented condition upon entering the set of tools and moving in a predetermined general direction in the set of tools, the set of tools comprising:

a dynamic storage lock chamber arranged to receive the ferrite members at one end in a consistent orientation;

a moveable distribution plate having a ferrite member stopping position and it ferrite member releasing position, said movable plate being arranged at the opposite end of said storage lock chamber;

a ferrite member distribution system coupled to said storage lock chamber with said movable plate being located at the interface between said storage lock chamber and said distribution system wherein said distribution system has a central ferrite member guide channel, access to which is controlled by displacement of said distribution plate, said movable distribution plate being actuated by a lever located on a side wall of said distribution system; and an exit nozzle at the end of said distribution system opposite to said storage lock chamber through which pass the ferrite members to be applied to the contact pins, said movable plate and a rate at which the ferrite members are fed to said exit nozzle being controlled by an operator.

9. The set of tools according to claim 8, wherein said lever is biased in a direction to urge said distribution plate to the stopping position.

* * * * *